US010269285B2

(12) United States Patent
Lee et al.

(10) Patent No.: US 10,269,285 B2
(45) Date of Patent: Apr. 23, 2019

(54) DISPLAY DEVICE AND METHOD OF DRIVING THE SAME

(71) Applicant: SAMSUNG DISPLAY CO., LTD., Yongin-si, Gyeonggi-Do (KR)

(72) Inventors: Changhoon Lee, Yongin-si (KR); Byeonghee Won, Yongin-si (KR); Ilnam Kim, Yongin-si (KR); Wonsang Park, Yongin-si (KR); Jongin Baek, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 365 days.

(21) Appl. No.: 15/054,661

(22) Filed: Feb. 26, 2016

(65) Prior Publication Data

US 2017/0069290 A1 Mar. 9, 2017

(30) Foreign Application Priority Data

Sep. 9, 2015 (KR) ..... 10-2015-0127716

(51) Int. Cl.
*G09G 3/20* (2006.01)

(52) U.S. Cl.
CPC ..... *G09G 3/2044* (2013.01); *G09G 3/2003* (2013.01); *G09G 2300/0426* (2013.01); *G09G 2300/0452* (2013.01); *G09G 2340/0457* (2013.01)

(58) Field of Classification Search
CPC ..... G09G 3/2003; G09G 3/2044; G09G 2300/0426; G09G 2300/0452; G09G 2340/0457
See application file for complete search history.

(56) References Cited

U.S. PATENT DOCUMENTS

| | | | | |
|---|---|---|---|---|
| 9,406,277 | B1 * | 8/2016 | Letourneur | G09G 5/10 |
| 9,867,962 | B2 * | 1/2018 | Mok | A61M 21/02 |
| 2005/0162360 | A1 * | 7/2005 | Ishihara | G09G 3/2011 345/89 |
| 2006/0152525 | A1 * | 7/2006 | Woog | G09G 5/003 345/589 |
| 2007/0013717 | A1 * | 1/2007 | Kempf | G09G 3/2051 345/596 |
| 2007/0296741 | A1 * | 12/2007 | Park | G09G 3/2003 345/690 |

(Continued)

FOREIGN PATENT DOCUMENTS

| | | |
|---|---|---|
| CN | 101984487 | 3/2011 |
| KR | 1020110123531 | 11/2011 |

(Continued)

*Primary Examiner* — Amare Mengistu
*Assistant Examiner* — Crystal Mathews
(74) *Attorney, Agent, or Firm* — F. Chau & Associates, LLC

(57) ABSTRACT

A display device includes: a display unit; a plurality of pixels disposed in the display unit, each pixel including first and second blue sub-pixels; and a driving mode controller configured to set a driving mode to one of a first driving mode in which both of the first and second blue sub-pixels emit light, and a second driving mode in which one of the first and second blue sub-pixels emits light, wherein the first blue sub-pixel emits light of a first frequency, and the second blue sub-pixel emits light of a second frequency different from the first frequency.

18 Claims, 7 Drawing Sheets

(56) References Cited

U.S. PATENT DOCUMENTS

2008/0224968 A1* 9/2008 Kashiwabara ..... G09G 3/2003 345/83
2009/0009453 A1* 1/2009 Furihata ..... G09G 3/3685 345/87
2009/0281604 A1* 11/2009 De Boer ..... A61M 21/00 607/88
2010/0123731 A1* 5/2010 Morimoto ..... G09G 3/3406 345/589
2010/0264850 A1* 10/2010 Yamamoto ..... G09G 5/14 315/312
2011/0273494 A1 11/2011 Jun
2012/0105517 A1* 5/2012 Yang ..... G09G 3/003 345/694
2012/0147065 A1* 6/2012 Byun ..... G09G 3/3208 345/690
2012/0256938 A1* 10/2012 So ..... G09G 3/3208 345/589
2013/0075579 A1* 3/2013 Chen ..... G01J 1/4204 250/205
2013/0328842 A1* 12/2013 Barnhoefer ..... G09G 3/3406 345/207
2014/0071030 A1 3/2014 Lee
2014/0098143 A1 4/2014 Lee et al.
2014/0118385 A1* 5/2014 Buckley ..... G09G 3/002 345/589
2015/0009194 A1* 1/2015 Kim ..... G09G 3/3233 345/211
2015/0009242 A1* 1/2015 Park ..... G09G 3/3233 345/690
2015/0062892 A1* 3/2015 Krames ..... H05B 37/0281 362/231
2015/0070337 A1* 3/2015 Bell ..... G09G 3/2003 345/207
2015/0194101 A1* 7/2015 Yaras ..... G09G 3/3413 345/593
2015/0332628 A1* 11/2015 Ren ..... G09G 3/3258 345/690
2015/0348468 A1* 12/2015 Chen ..... G09G 3/3413 345/207
2016/0005362 A1* 1/2016 Chen ..... G09G 3/3406 345/690
2016/0121073 A1* 5/2016 Mok ..... G09G 3/20 600/27
2016/0129218 A1* 5/2016 Mok ..... A61M 21/02 345/694
2016/0189670 A1* 6/2016 Kim ..... G09G 5/02 345/690
2016/0243379 A1* 8/2016 Hommes ..... A61N 5/0618
2016/0293139 A1* 10/2016 Kwon ..... G09G 5/02
2017/0061842 A1* 3/2017 Cok ..... G09G 3/2003
2017/0193880 A1* 7/2017 Lee ..... G09G 3/2003

FOREIGN PATENT DOCUMENTS

KR 10-1146992 5/2012
KR 1020140035239 3/2014
KR 1020140044568 4/2014

* cited by examiner

DISPLAY DEVICE AND METHOD OF DRIVING THE SAME

CROSS-REFERENCE TO RELATED APPLICATION

This application claims priority under 35 U.S.C. § 119 to Korean Patent Application No. 10-2015-0127716, filed on Sep. 9, 2015, in the Korean Intellectual Property Office, the disclosure of which is incorporated by reference herein in its entirety.

TECHNICAL FIELD

Exemplary embodiments of the inventive concept relate to a display device and a method of driving the same.

DESCRIPTION OF THE RELATED ART

Melatonin is a hormone that is secreted from a human body and serves as a biological clock. For example, when night comes, melatonin is secreted to inform parts of the body that night is approaching. When melatonin is secreted, sleep is induced.

When morning comes and light illuminates, melatonin secretion is suppressed and a human begins to wake. For example, when a wavelength ranging from about 464 nm to about 470 nm is recognized by a human body, melatonin secretion is suppressed. In other words, a human body discriminates between night and day depending on the recognition of a wavelength in the range from about 464 nm to about 470 nm. Generally, since people recognize light having a central wavelength ranging from about 440 nm to about 495 nm as blue light, a wavelength ranging from about 464 nm to about 470 nm is considered as blue light.

Therefore, when an audience views an image via an electronic device such as a television (TV), a smartphone, and a personal computer (PC), in the case where light of a wavelength ranging from about 464 nm to about 470 nm is emitted from the electronic device, secretion of the audience's melatonin may be suppressed. Therefore, the normal sleeping pattern of a person in the audience may be disturbed.

SUMMARY

According to an exemplary embodiment of the inventive concept, a display device includes: a display unit; a plurality of pixels disposed in the display unit, each pixel including first and second blue sub-pixels; and a driving mode controller configured to set a driving mode to one of a first driving mode in which both of the first and second blue sub-pixels emit light, and a second driving mode in which one of the first and second blue sub-pixels emits light, wherein the first blue sub-pixel emits light of a first frequency, and the second blue sub-pixel emits light of a second frequency different from the first frequency.

A central wavelength of the light emitted from the first blue sub-pixel is longer than a central wavelength of the light emitted from the second blue sub-pixel.

The central wavelength of the light emitted from the first blue sub-pixel is in a range from about 464 nm to about 470 nm, and the central wavelength of the light emitted from the second blue sub-pixel is in a range from about 440 nm to about 464 nm.

The second driving mode includes a (2-1)-th driving mode in which the first blue sub-pixel emits light, and a (2-2)-th driving mode in which the second blue sub-pixel emits light.

The driving mode controller is configured to determine a current time as day or night, set the driving mode to one of the first driving mode and the (2-1)-th driving mode when the current time is day, and set the driving mode to the (2-2)-th driving mode when the current time is night.

The driving mode controller is configured to determine a current location as an outdoor space or an indoor space, set the driving mode to the first driving mode when the current location is the outdoor space, and set the driving mode to one of the (2-1)-th driving mode and the (2-2)-th driving mode when the current location is the indoor space.

The device further includes: an output signal generator configured to receive an input image signal, and generate an output signal based on the input image signal, wherein the output signal generator generates a first output signal to allow the first and second blue sub-pixels to emit light when the driving mode is the first driving mode, generates a second output signal to allow the first blue sub-pixel emit light when the driving mode is the (2-1)-th driving mode, and generates a third output signal to allow the second blue sub-pixel to emit light when the driving mode is the (2-2)-th driving mode.

When the input image signal comprises first and second red image signals, first and second green image signals, and first and second blue image signals, the output signal generator: generates an output red image signal corresponding to the first and second red image signals, generates an output green image signal corresponding to the first and second green image signals, generates first and second output blue image signals corresponding to the first and second blue image signals when the driving mode is the first driving mode, generates the first blue image signal corresponding to the first and second blue image signals when the driving mode is the (2-1)-th driving mode, and generates the second blue image signal corresponding to the first and second blue image signals when the driving mode is the (2-2)-th driving mode.

The device further includes: a source driver configured to receive the output red image signal, the output green image signal, and the first and second output blue image signals, and apply data signals to the plurality of pixels, wherein each of the plurality of pixels comprises a red sub-pixel and a green sub-pixel, and the source driver applies a data signal generated based on the output red image signal to the red sub-pixel, applies a data signal generated based on the output green image signal to the green sub-pixel, applies a data signal generated based on the first output blue image signal to the first blue sub-pixel, and applies a data signal generated based on the second output blue image signal to the second blue sub-pixel.

The output signal generator is configured to perform gamma correction by using a first gamma value when the driving mode is the first driving mode, by using a second gamma value when the driving mode is the (2-1)-th driving mode, and by using a third gamma value when the driving mode is the (2-2)-th driving mode.

Each of the plurality of pixels further comprises at least two sub-pixels that emit a different color than a blue color.

Each of the plurality of pixels comprises a red sub-pixel and a green sub-pixel.

Each of the plurality of pixels comprises a first sub-pixel group comprising the red sub-pixel and the green sub-pixel arranged in a first direction, and a second sub-pixel group comprising the first and second blue sub-pixels arranged in the first direction, and the display unit comprises a first sub-pixel row in which the first sub-pixel group is arranged in the first direction, and a second sub-pixel row in which the second sub-pixel group is arranged in the first direction.

The display unit comprises the first and second sub-pixel rows arranged in a second direction substantially perpendicular to the first direction, the first sub-pixel row includes: a (1-1)-th sub-pixel row in which the red sub-pixel and the green sub-pixel are repeatedly arranged in sequence, and a (1-2)-th sub-pixel row in which the green sub-pixel and the red sub-pixel are repeatedly arranged in sequence, and the second sub-pixel row includes: a (2-1)-th sub-pixel row in which the first blue sub-pixel and the second blue sub-pixel are repeatedly arranged in sequence, and a (2-2)-th sub-pixel row in which the second blue sub-pixel and the first blue sub-pixel are repeatedly arranged in sequence.

According to an exemplary embodiment of the inventive concept, a method of driving a display device including a display unit, a plurality of pixels disposed in the display unit, each pixel including first and second blue sub-pixels, and a driving mode controller configured to set a driving mode to one of a first driving mode in which both of the first and second blue sub-pixels emit light, a (2-1)-th driving mode in which the first blue sub-pixel emits light, and a (2-2)-th driving mode in which the second blue sub-pixel emits light, wherein the first blue sub-pixel emits light of a first frequency, and the second blue sub-pixel emits light of a second frequency different from the first frequency, the method includes: determining a current time as day or night; determining a current position as an outdoor space or an indoor space; and setting the driving mode to the first driving mode when the current time is day and the current position is the outdoor space, setting the driving mode to the (2-1)-th driving mode when the current time is day and the current position is the indoor space, and setting the driving mode to the (2-2)-th driving mode when the current time is night.

The method further includes: receiving an input image signal; and generating an output signal based on the input image signal, wherein the generating of the output signal comprises: generating a first output signal to allow the first and second blue sub-pixels to emit light when the driving mode is the first driving mode, generating a second output signal to allow the first blue sub-pixel to emit light when the driving mode is the (2-1)-th driving mode, and generating a third output signal to allow the second blue sub-pixel to emit light when the driving mode is the (2-2)-th driving mode.

When the input image signal comprises first and second red image signals, first and second green image signals, and first and second blue image signals, the generating of the output signal includes: generating an output red image signal corresponding to the first and second red image signals; generating an output green image signal corresponding to the first and second green image signals; generating first and second output blue image signals corresponding to the first and second blue image signals when the driving mode is the first driving mode, generating the first blue image signal corresponding to the first and second blue image signals when the driving mode is the (2-1)-th driving mode, and generating the second blue image signal corresponding to the first and second blue image signals when the driving mode is the (2-2)-th driving mode.

The method further includes: after the generating of the output signal, applying a data signal generated based on the output red image signal to a red sub-pixel, applying a data signal generated based on the output green image signal to a green sub-pixel, applying a data signal generated based on the first output blue image signal to the first blue sub-pixel, and applying a data signal generated based on the second output blue image signal to the second blue sub-pixel.

The generating of the output signal includes: performing gamma correction by using a first gamma value when the driving mode is the first driving mode, by using a second gamma value when the driving mode is the (2-1)-th driving mode, and by using a third gamma value when the driving mode is the (2-2)-th driving mode.

According to an exemplary embodiment of the inventive concept, a display unit including a plurality of pixels, at least one of the pixels including a first blue sub-pixel and a second blue sub-pixel; and a controller configured to drive at least one of the first and second blue sub-pixels based on a driving mode, the driving mode being based on a current time of day and a current location of the display device.

The features of the aforementioned exemplary embodiments may be embodied by using a system, a method, a computer program, or a combination of a system, a method, and a computer program.

BRIEF DESCRIPTION OF THE DRAWINGS

The above and other features of the inventive concept will become more apparent by describing in detail exemplary embodiments thereof, with reference to the accompanying drawings in which.

DETAILED DESCRIPTION OF THE EMBODIMENTS

Figure 1:
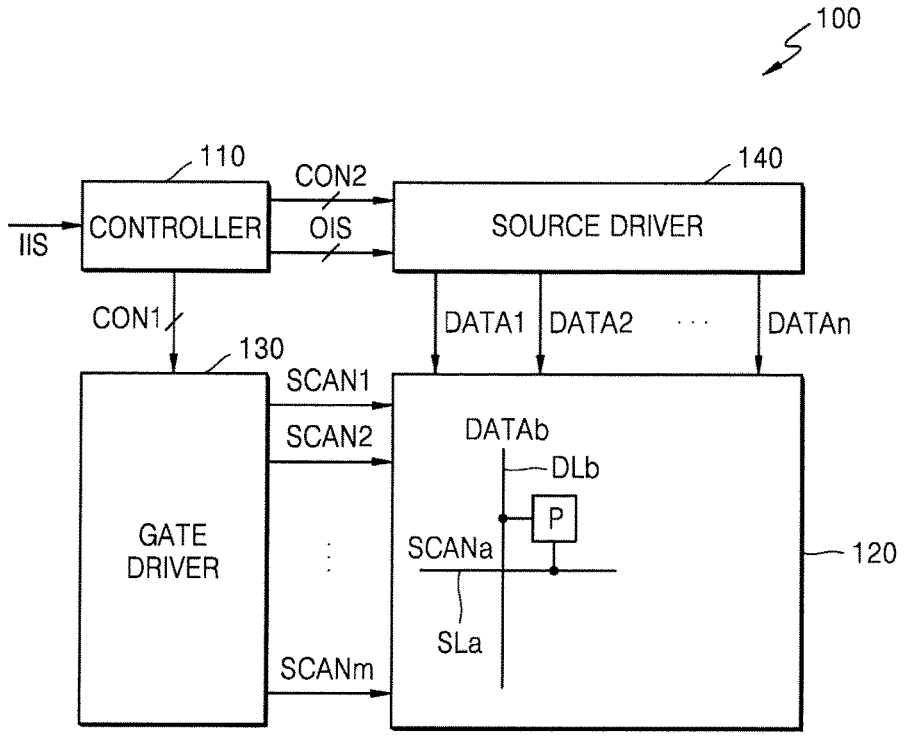
FIG. 1 is a block diagram illustrating a display device according to an exemplary embodiment of the inventive concept.

Exemplary embodiments of the inventive concept will now be described below in detail together with the drawings. However, the inventive concept is not limited to the below exemplary embodiments and may be implemented in various forms.

As used herein, the singular forms "a," "an" and "the" are intended to include the plural forms as well, unless the context clearly indicates otherwise.

Like reference numerals in the drawings may denote like or corresponding elements, and thus, a repeated description thereof will be omitted.

FIG. 1 is a block diagram illustrating a display device 100 according to an exemplary embodiment of the inventive concept.

Referring to FIG. 1, the display device 100 may include a controller 110, a display unit 120, a gate driver 130, and a source driver 140. The controller 110, the gate driver 130, and the source driver 140 may be respectively formed in separate semiconductor chips, and integrated in one semiconductor chip. In addition, the controller 110, the gate driver 130 and/or the source driver 140 may be formed on a substrate on which the display unit 120 is formed.

The display device 100 may be a liquid crystal display apparatus, an organic light-emitting display device, a flexible display, a three-dimensional (3-D) display, an electrophoretic display, etc. The inventive concept is not limited thereto and various electronic devices that may provide visual information by emitting light may be the display device 100. Hereinafter, the case where the display device 100 is an organic light-emitting display device is described as an example.

The display device 100 may display an image via a pixel P. The display device 100 may be, for example, an electronic device, such as a smartphone, a tablet personal computer (PC), a notebook PC, a monitor, and a television (TV), and may be a part for displaying an image of an electronic device.

A pixel P may include a plurality of sub-pixels that respectively display a plurality of colors to display various colors. Throughout the specification, a pixel P mainly denotes one sub-pixel. However, exemplary embodiments are not limited thereto and a pixel P may denote one unit pixel including a plurality of sub-pixels. In other words, even when it is described that one pixel P exists in the present specification, it may be construed that one sub-pixel exists and that a plurality of sub-pixels forming one unit pixel exist.

A pixel P may include a light-emitting device and a pixel circuit. The pixel circuit may receive a driving voltage and a data signal, and output a driving current to the light-emitting device. In this case, the driving voltage may include a first driving voltage and a second driving voltage. The first driving voltage may be a driving voltage having a relatively high level, and the second driving voltage may be a driving voltage having a relatively low level. A level of a driving voltage supplied to each pixel P may be a difference in a level between the first driving voltage and the second driving voltage.

The display device 100 may receive a plurality of image frames from the outside. The plurality of image frames may be image frames that allow one moving image to be displayed when a plurality of image frames are sequentially displayed. Each of the plurality of image frames may include an input image signal IIS. The input image signal IIS may include information regarding luminance of light emitted via a pixel P, and a number of bits of an input image signal IIS may be determined depending on a predetermined step of brightness. For example, in the case where a number of steps of brightness of light emitted via a pixel P is 256, an input image signal IIS may be an 8-bit digital signal. In the case where a darkest gray scale that may be displayed via the display unit 120 is a first step, and a brightest gray scale that may be displayed via the display unit 120 is a 256-th step, an input image signal IIS corresponding to the first step may be 0 and an input image signal IIS corresponding to the 256-th step may be 255. The darkest gray scale that may be displayed via the display unit 120 may be referred to as a minimum gray scale, and the brightest displayable gray scale may be referred to as a maximum gray scale. A number of steps of brightness of light emitted via a pixel P may be determined as various numbers such as 64, 256, and 1024.

The controller 110 may be connected to the display unit 120, the gate driver 130, and the source driver 140. The controller 110 may receive an input image signal IIS and output first control signals CON1 to the gate driver 130. The first control signals CON1 may include a horizontal synchronization signal HSYNC. The first control signals CON1 may include control signals which the gate driver 130 uses for outputting scan signals SCAN1 to SCANm synchronized with a horizontal synchronization signal HSYNC. The controller 110 may output second control signals CON2 to the source driver 140.

The controller 110 may output an output image signal OIS to the source driver 140. The second control signals CON2 may include control signals which the source driver 140 uses for outputting data signals DATA1 to DATAn corresponding to the output image signal OIS. The output image signal OIS may include image information used for generating the data signals DATA1 to DATAn. The output image signal OIS may be image data generated by correcting an input image signal IIS received from the outside.

The display unit 120 may include a plurality of pixels, a plurality of scan lines each being connected to pixels located in one row from among the plurality of pixels, and a plurality of data lines each being connected to pixels located in one column from among the plurality of pixels. For example, as illustrated in FIG. 1, the display unit 120 may include a pixel P included in a plurality of pixels. In this case, the pixel P may be a pixel P disposed in an "a"-th row and a "b"-th column of the display unit 120. In this case, the display unit 120 may include an "a"-th scan line SLa connected to all pixels located in the "a"-th row, and a "b"-th data line DLb connected to all pixels located in the "b"-th column. In this case, the "a"-th scan line SLa and the "b"-th data line DLb may be connected with the pixel P.

The gate driver 130 may output scan signals SCAN1 to SCANm to the scan lines. The gate driver 130 may output scan signals SCAN1 to SCANm in synchronization with a vertical synchronization signal. The pixel P may receive scan signal SCANa as shown in FIG. 1.

The source driver 140 may output data signals DATA1 to DATAn to the data lines in synchronization with scan signals SCAN1 to SCANm. The source driver 140 may output data signals DATA1 to DATAn proportional to input image data to the data lines. The pixel P may receive data signal DATAb as shown in FIG. 1.

Generally, an electronic device that displays an image displays an image by using a plurality of sub-pixels respectively emitting different light. Such an electronic device may include, for example, sub-pixels respectively emitting light of red, green, and blue colors. Among the color light, blue light may include a large amount of light having a wavelength ranging from about 464 nm to about 470 nm. Light having a wavelength ranging from about 464 nm to about 470 nm suppresses melatonin secretion, which can negatively impact a viewer's normal sleeping pattern.

The display device 100 according to an exemplary embodiment of the inventive concept may not adversely impact a viewer's normal sleeping pattern. For example, the display device 100 according to an exemplary embodiment of the inventive concept may include two kinds of blue sub-pixels respectively having different central wavelengths. For example, a central wavelength of first blue light may be longer than a central wavelength of second blue light. For example, the display device 100 according to an exemplary embodiment of the inventive concept may include a first blue sub-pixel that emits the first blue light having a central wavelength ranging from about 464 nm to about 470 nm, and a second blue sub-pixel that emits the second blue light having a central wavelength ranging from about 440 nm to about 464 nm. For example, the first blue sub-pixel may emit light blue light, and the second blue sub-pixel may emit dark blue light.

Since light emitted from the first blue sub-pixel has a central wavelength ranging from about 464 nm to about 470 nm, the light may suppress melatonin secretion of a viewer. In addition, since light emitted from the second blue sub-pixel has a central wavelength ranging from about 440 nm to about 464 nm which is separated from a band ranging from about 464 nm to about 470 nm, the light emitted from the second blue sub-pixel may not suppress melatonin secretion. Therefore, the light emitted from the second blue sub-pixel induces sleep in a viewer, and the light emitted from the first blue sub-pixel keeps a viewer awake. Therefore, the display device 100 according to an exemplary embodiment of the inventive concept may wake-up a viewer or induce sleep in a viewer by driving the two blue sub-pixels in a particular driving mode.

Figure 2:
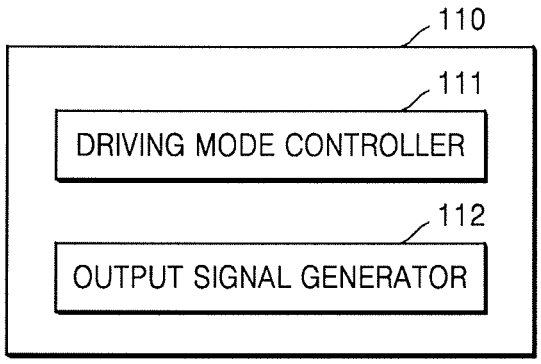
FIG. 2 is a block diagram illustrating a controller according to an exemplary embodiment of the inventive concept.

FIG. 2 is a block diagram illustrating a configuration of the controller 110 according to an exemplary embodiment of the inventive concept.

Referring to FIG. 2, the controller 110 according to an exemplary embodiment of the inventive concept may include a driving mode controller 111 and an output signal generator 112. The controller 110 may further include general components besides the components illustrated in FIG. 2.

The controller 110 according to the present exemplary embodiment may correspond to one or more processors or include one or more processors. Accordingly, the controller 110 may be driven in a form included in another hardware device such as a microprocessor or a general computer system.

Referring to FIG. 2, the controller 110 according to an exemplary embodiment of the inventive concept includes the driving mode controller 111 and the output signal generator 112. The driving mode controller 111 and the output signal generator 112 may be respectively formed in separate semiconductor chips, and integrated in one semiconductor chip.

The driving mode controller 111 according to an exemplary embodiment of the inventive concept may set a driving mode of the display unit 120. A method of setting the driving mode by the driving mode controller 111 is described with reference to FIGS. 3 and 4.

The output signal generator 112 may generate an output image signal OIS to be applied to the display unit 120. The output signal generator 112 may receive an input image signal IIS from the outside, and generate an output image signal OIS based on the input image signal IIS. The output signal generator 112 may output an output image signal OIS to the source driver 140 to allow a data voltage corresponding to the output image signal OIS to be applied to the display unit 120 via the source driver 140. A method of generating an output image signal OIS by the output signal generator 112 is described with reference to FIG. 5.

Figure 3:
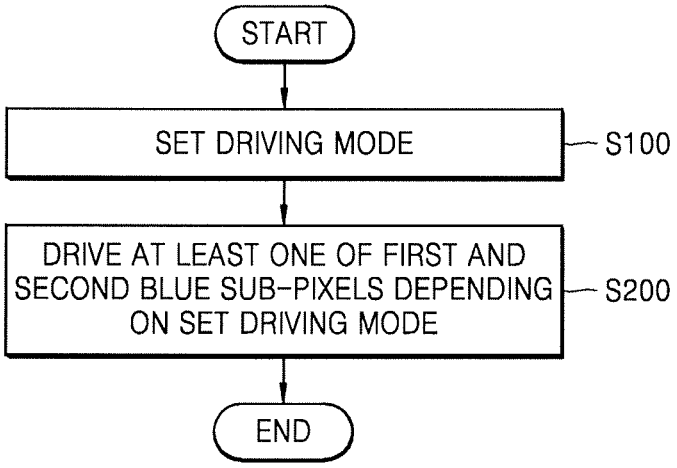
FIGS. 3, 4 and 5 are flowcharts illustrating a method of driving a display device according to an exemplary embodiment of the inventive concept.
Figure 4:
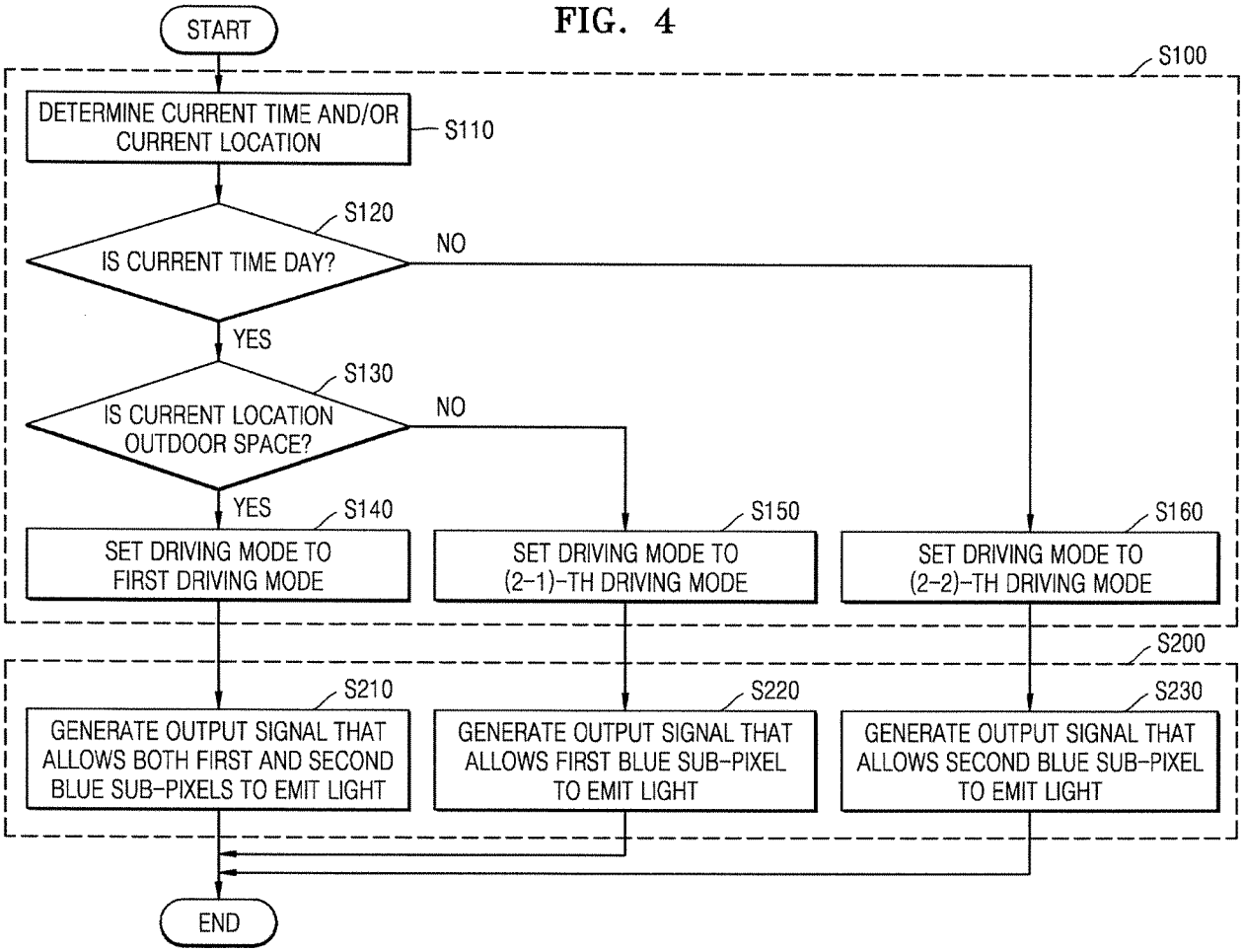
Figure 5:
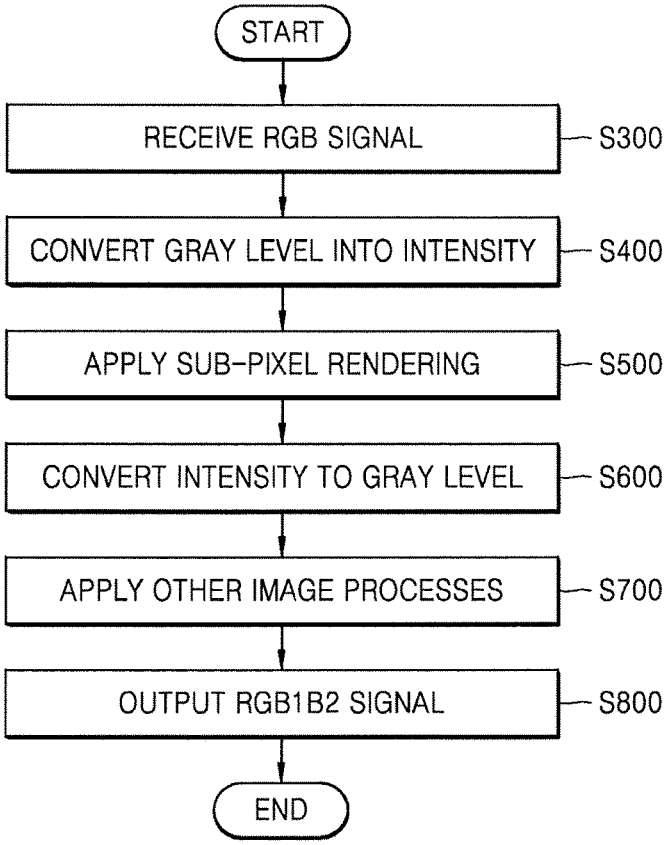

FIGS. 3 to 5 are flowcharts illustrating a method of driving a display device according to an exemplary embodiment of the inventive concept.

The flowchart illustrated in FIGS. 3 to 5 includes operations processed in time series by the controller 110 illustrated in FIGS. 1 and 2. Therefore, content regarding components illustrated in FIGS. 1 and 2 and described above is applicable to the flowchart illustrated in FIGS. 3 to 5.

Referring to FIG. 3, the display device 100 according to the present exemplary embodiment may perform an operation (operation S100) of setting a driving mode. In this case, the display device 100 may set the driving mode of the display device 100 based on a time when the display device 100 is driven and/or a location where the display device 100 is driven. The driving mode may be divided according to a driving method of a blue sub-pixel. For example, the driving mode may include a first driving mode that uses both a first blue sub-pixel and a second blue sub-pixel to display a blue color, and a second driving mode that uses only one of the first blue sub-pixel and the second blue sub-pixel to display the blue color. In this case, the second driving mode may include a (2-1)-th driving mode that uses the first blue sub-pixel to display the blue color, and a (2-2)-th driving mode that uses the second blue sub-pixel to display the blue color. The setting of the driving mode may be performed by the driving mode controller 111 of the display device 100.

After that, the display device 100 may perform an operation (operation S200) of driving at least a portion of the first blue sub-pixel and the second blue sub-pixel depending on the set driving mode. In other words, the display device 100 may induce a viewer's sleeping or wake-up states based on a current time and a current location, and output an image at a brightness suitable for a viewing environment. This driving may be performed by the controller 110, the source driver 140, and the display unit 120 of the display device 100.

An example of determining the driving mode of the display device 100 and driving the display device 100 according to the driving mode is described with reference to FIG. 4.

Referring to FIG. 4, the display device 100 may perform an operation (operation S110) of determining a current time and a current location. The display device 100 may measure a current time by using a time measurement device in the display device 100, and receive information regarding a current time from the outside. The display device 100 may also determine a current time based on a switching period of a predetermined driving mode, and recognize a current time as day or night based on information of ambient illuminance using a part in the display device 100 or received from the outside. In this case, the display device 100 may determine a current time, divide one day into a plurality of time sections and determine a time section to which the current time belongs, and determine whether the current time is day or night. In addition, the display device 100 may determine a current location by using a global positioning system (GPS), etc. in the display device 100, receive information regarding a current location from the outside, and determine a current location as an indoor space or an outdoor space based on information of ambient illuminance using a part in the display device 100 or received from the outside.

After that, the display device 100 may perform an operation (operation S120) of determining whether a current time is day or night. If the current time is day, the display device 100 may perform an operation (operation S130) of determining whether a current location is an outdoor space.

When the current time is day and the current location is an outdoor space, the display device 100 may perform an operation (operation S140) of setting the driving mode to the first driving mode. When the current time is day and the current location is an indoor space, the display device 100 may perform an operation (operation S150) of setting the driving mode to the (2-1)-th driving mode. When the current time is night, the display device 100 may perform an operation (operation S160) of setting the driving mode to the (2-2)-th driving mode.

Operations S110 to S160 may be included in operation S100, and performed by the driving mode controller 111 of the display device 100.

When the driving mode is set to the first driving mode, the display device 100 may perform an operation (operation S210) of generating an output signal that allows both first and second blue sub-pixels to emit light. In addition, when the driving mode is set to the (2-1)-th driving mode, the display device 100 may perform an operation (operation S220) of generating an output signal that allows the first blue sub-pixel to emit light. In addition, when the driving mode is set to the (2-2)-th driving mode, the display device 100 may perform an operation (operation S230) of generating an output signal that allows the second blue sub-pixel to emit light.

In other words, when the current time is day, the display device 100 may provide a wake-up effect by allowing the first blue sub-pixel to emit light and thus suppressing melatonin secretion of a viewer. When the current time is night, in order not to disturb a viewer's sleeping pattern, the display device 100 may a display blue color by using only the second blue sub-pixel. In addition, when the current time is day and the current location is an outdoor space, since ambient illuminance is relatively high, the display device 100 may increase brightness of light output from the display device 100 by allowing both the first and second blue sub-pixels to emit light. When the current time is day and the current location is an indoor space, since ambient illuminance is relatively low, the display device 100 may display the blue color by using only the first blue sub-pixel.

Operations S210 to S230 may be included in operation S200, and performed by the output signal generator 112 of the display device 100.

An example of generating an output image signal OIS to drive the display device 100 according to a determined driving mode is described with reference to FIG. 5.

Referring to FIG. 5, the output signal generator 112 according to the present exemplary embodiment may perform an operation (operation S300) of receiving an RGB signal, which is an input image signal IIS, from the outside. The RGB signal may be a red image signal, a green image signal, and a blue image signal. In addition, the RGB signal may be an 8-bit or a 10-bit image signal, and may be an image signal having a number of various bits.

After that, the output signal generator 112 may perform an operation (operation S400) of performing de-gamma correction on each of a red image signal, a green image signal, and a blue image signal to convert a received RGB signal into a numerical value linearly representing the intensity of light.

For example, a change of a gray level in an RGB signal may not linearly coincide with a change of the intensity of light actually recognized by a human being. In other words, the intensity of light in the case where a gray level is 100 may not be double the intensity of light in the case where a gray level is 50. Therefore, a process of changing a linear numerical value into a gray level depending on a change of the intensity of light is used. Such a process is referred to as gamma correction. An RGB signal received from the outside may be in a gamma-corrected state.

Here, the present exemplary embodiment may include a process of calculating an average of two different sub-pixel values. For example, the output signal generator 112 may perform an operation of changing each of a red image signal, a green image signal, and a blue image signal included in a received RGB signal into a linear numerical value depending on a change of the intensity of light. This process is referred to as de-gamma correction.

After that, the output signal generator 112 may perform an operation (operation S500) of applying sub-pixel rendering to a numerical value that expresses a change of the intensity of light by using a linear change. For example, in the case where each of the pixels has three sub-pixels of a red sub-pixel, a green sub-pixel, and a blue sub-pixel, a received RGB signal may be a signal having gray levels respectively corresponding to the sub-pixels. In this case, the display device 100 according to the present exemplary embodiment may be designed such that one pixel includes four sub-pixels of a red color, a green color, a first blue color, and a second blue color. In addition, in the case where one pixel includes three sub-pixels of a red color, a green color, and a blue color, the display device 100 according to the present exemplary embodiment may be designed to express, by using only one pixel, image information to be expressed by using two pixels. In this case, assuming that information included in two successive input signals includes first and second red image signals, first and second green image signals, and first and second blue image signals, the output signal generator 112 may generate four signals of an output red image signal, an output green image signal, a first output blue image signal, and a second output blue image signal by using six signals. In this case, the output signal generator 112 may calculate an output red image signal by using an average value of the first and second red image signals, and calculate an output green image signal by using an average value of the first and second green image signals. In addition, the output signal generator 112 may calculate the first and second output blue image signals by using different methods depending on whether the driving mode is the first driving mode, the (2-1)-th driving mode, or the (2-2)-th driving mode.

For example, when the driving mode is the first driving mode, the output signal generator 112 may directly borrow a value of the first blue image signal and apply that value as the first output blue image signal, and may directly borrow a value of the second blue image signal and apply that value as the second output blue image signal. In other words, since image signals representing a blue color from among input image signals may one-to-one correspond to sub-pixels in use from among blue sub-pixels of the display device 100, the output signal generator 112 may directly use an input image signal as an output image signal.

In addition, when the driving mode is the (2-1)-th driving mode, the output signal generator 112 may calculate the first output blue image signal by using an average value of the first and second blue image signals. In other words, since the (2-1)-th driving mode uses only the first blue sub-pixel and does not use the second blue sub-pixel, the output signal generator 112 may display the first blue image signal and the second blue image signal by using the above method based on the first blue sub-pixel. In this case, the output signal generator 112 may output 0 as a pixel value corresponding to the second blue sub-pixel.

In addition, when the driving mode is the (2-2)-th driving mode, the output signal generator 112 may calculate the second output blue image signal by using an average value of the first and second blue image signals. In other words, since the (2-2)-th driving mode uses only the second blue sub-pixel and does not use the first blue sub-pixel, the output signal generator 112 may display the first blue image signal and the second blue image signal by using the above method based on the second blue sub-pixel. In this case, the output signal generator 112 may output 0 as a pixel value corresponding to the first blue sub-pixel.

After that, the output signal generator 112 may perform an operation (operation S600) of applying a gamma to each of an intensity value of red light, an intensity value of green light, an intensity value of first blue light, and an intensity value of second blue light to express intensity values of sub-pixel rendering-applied to the red, green, first blue, and second blue light by using gray levels again.

In the case of expressing a first red image signal as RI1, a second red image signal as RI2, a first green image signal as GI1, a second green image signal as GI2, a first blue image signal BI1, a second blue image signal BI2, an output red image signal RO, an output green image signal GO, a first output blue image signal BO1, and a second output blue image signal BO2, operations S400 to S600 may be expressed by Equations 1 to 9 below.

For example, in the first driving mode, the (2-1)-th driving mode, and the (2-2)-th driving mode, an output red image signal and an output green image signal may be expressed by Equations 1 and 2 below.

$$RO = 255 \times \left( \frac{\left(\frac{RI1}{255}\right)^{2.2} + \left(\frac{RI2}{255}\right)^{2.2}}{2} \right)^{\frac{1}{2.2}} \quad \text{Equation 1}$$

$$GO = 255 \times \left( \frac{\left(\frac{GI1}{255}\right)^{2.2} + \left(\frac{GI2}{255}\right)^{2.2}}{2} \right)^{\frac{1}{2.2}} \quad \text{Equation 2}$$

In addition, an example of a process of calculating first and second output blue image signals in the first driving mode may be expressed by Equations 3 and 4 below.

$$BO1 = BI1 \quad \text{Equation 3}$$

$$BO2 = BI2 \quad \text{Equation 4}$$

In addition, an example of a process of calculating first and second output blue image signals in the (2-1)-th driving mode may be expressed by Equations 5 and 6 below.

$$BO1 = 255 \times \left( \frac{\left(\frac{BI1}{255}\right)^{2.2} + \left(\frac{BI2}{255}\right)^{2.2}}{2} \right)^{\frac{1}{2.2}} \quad \text{Equation 5}$$

$$BO2 = 0 \quad \text{Equation 6}$$

In addition, an example of a process of calculating first and second output blue image signals in the (2-2)-th driving mode may be expressed by Equations 7 and 8 below.

$$BO1 = 0 \quad \text{Equation 7}$$

$$BO2 = 255 \times \left( \frac{\left(\frac{BI1}{255}\right)^{2.2} + \left(\frac{BI2}{255}\right)^{2.2}}{2} \right)^{\frac{1}{2.2}} \quad \text{Equation 8}$$

After that, the output signal generator 112 may perform an operation (operation S700) of performing various image processes on the red, green, first blue, and second blue image signals. Various algorithms such as color enhancement, edge enhancement, noise filtering, and dithering may be applied to these image processes, and the display device 100 may perform an image process by applying various image processing algorithms besides the above algorithms.

After that, the output signal generator 112 may output a generated output red image signal, output green image signal, first output blue image signal, and second output blue image signal (operation S800).

Through this method, the display device 100 according to the present exemplary embodiment may suppress secretion of a viewer's melatonin and thus provide a wake-up effect during the daytime, and may not hinder secretion of a viewer's melatonin and thus induce sleeping at night by driving two blue sub-pixels depending on the driving mode. In addition, the display device 100 may provide an image of a brightness suitable for a location to an audience (e.g., person or persons viewing the display device 100) by determining whether the audience's view location is an indoor space or an outdoor space.

Figure 6:
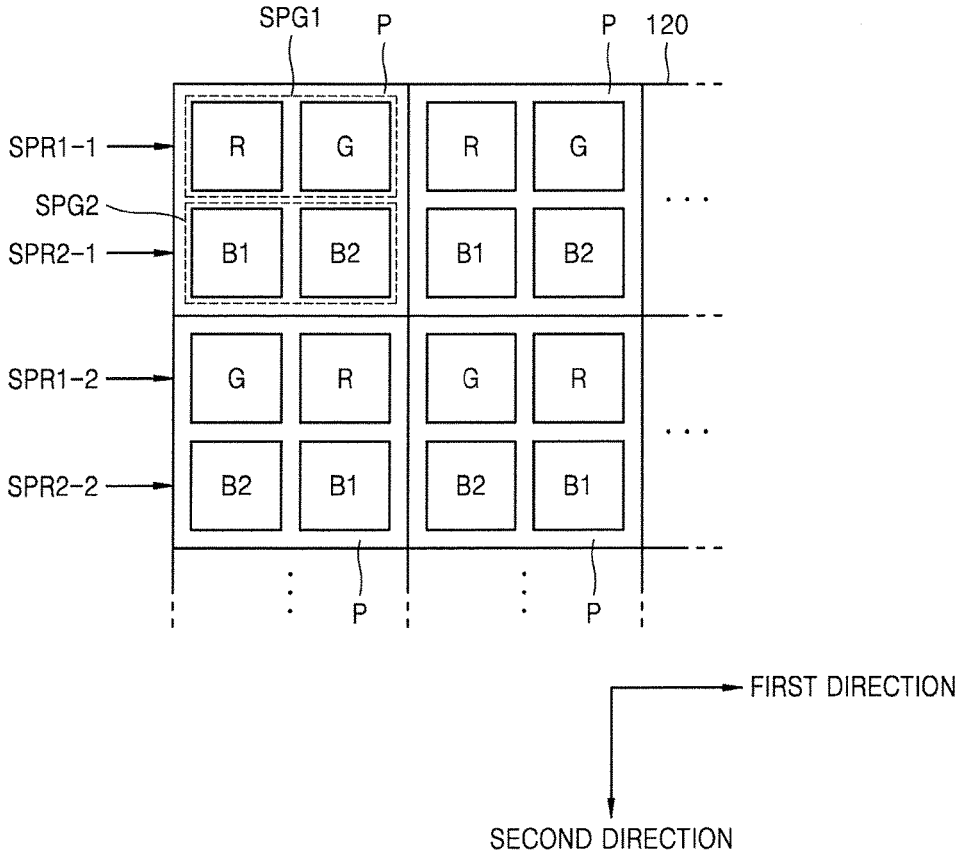
FIGS. 6 and 7 are diagrams illustrating a pixel structure according to an exemplary embodiment of the inventive concept.
Figure 7:
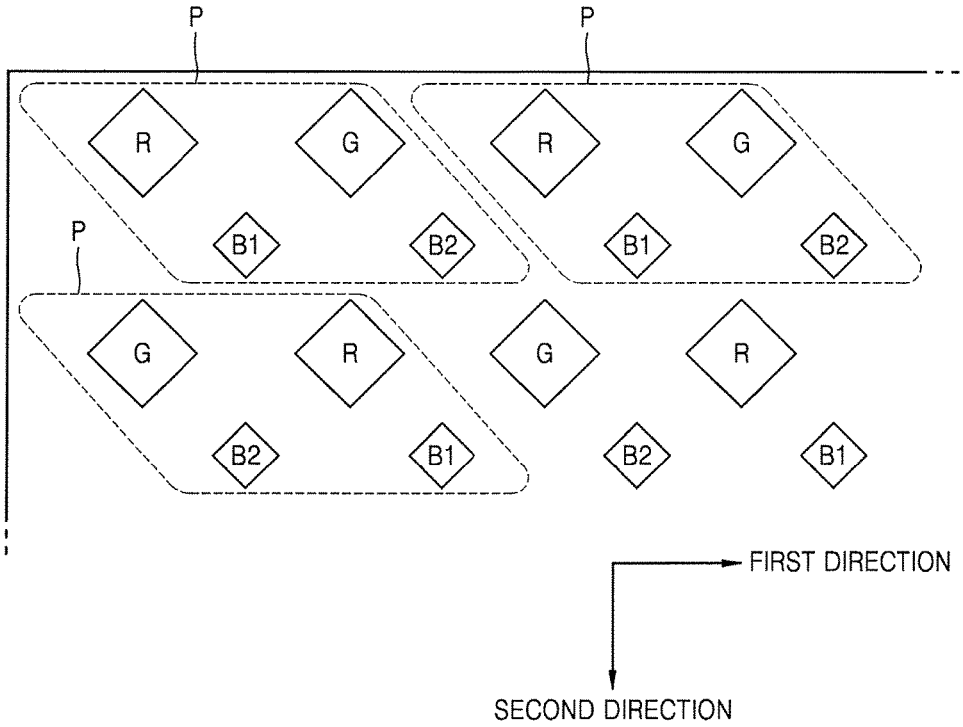

FIGS. 6 and 7 are diagrams illustrating a pixel structure according to an exemplary embodiment of the inventive concept.

Referring to FIG. 6, the display unit 120 of the display device 100 according to an exemplary embodiment of the inventive concept may include a plurality of pixels P. In this case, each pixel P may include a red sub-pixel R, a green sub-pixel G, a first blue sub-pixel B1, and a second blue sub-pixel B2.

In this case, each pixel P may include a first sub-pixel group SPG1 including a red sub-pixel R and a green sub-pixel G, and a second sub-pixel group SPG2 including a first blue sub-pixel B1 and a second blue sub-pixel B2. In this case, the same sub-pixel groups may be disposed in the same sub-pixel row. In other words, all sub-pixel groups disposed in the same row in which the illustrated first sub-pixel group SPG1 is disposed may be the first sub-pixel groups SPG1, and all sub-pixel groups disposed in the same row in which the illustrated second sub-pixel group SPG2 is disposed may be the second sub-pixel groups SPG2. In this case, a row in which the first sub-pixel groups SPG1 are disposed may be referred to as a first sub-pixel row SPR1, and a row in which the second sub-pixel groups SPG2 are disposed may be referred to as a second sub-pixel row SPR2. In this case, in the display device 100 according to the present exemplary embodiment, the first sub-pixel row SPR1 and the second sub-pixel row SPR2 may be disposed alternately in a second direction perpendicular to a first direction. In other words, as illustrated in FIG. 6, all odd-numbered sub-pixel rows may be the first sub-pixel rows SPR1, and all even-numbered sub-pixel rows may be the second sub-pixel rows SPR2.

In the first sub-pixel group SPG1, sub-pixels may be disposed in the order of a red sub-pixel R and a green sub-pixel G from the left, and may be disposed in the order of a green sub-pixel G and a red sub-pixel R from the left. In the second sub-pixel group SPG2, sub-pixels may be disposed in the order of a first blue sub-pixel B1 and a second blue sub-pixel B2 from the left, and may be disposed in the order of a second blue sub-pixel B2 and a first blue sub-pixel B1 from the left. In this case, all sub-pixel groups included in the same sub-pixel row may have the same arrangement. In other words, in the case where one first sub-pixel group SPG1 included in one first sub-pixel row SPR1 includes sub-pixels disposed in the order of a red sub-pixel R and a green sub-pixel G from the left, all first sub-pixel groups SPG1 included in the one first sub-pixel row SPR1 may be the first sub-pixel groups SPG1 each including sub-pixels disposed in the order of a red sub-pixel R and a green sub-pixel G from the left.

Here, the first sub-pixel row SPR1 including the first sub-pixel groups SPG1 in which sub-pixels are disposed in the order of a red sub-pixel R and a green sub-pixel G from the left may be referred to as a (1-1)-th sub-pixel row SPR1-1, and the first sub-pixel row SPR1 including the first sub-pixel groups SPG1 in which sub-pixels are disposed in the order of a green sub-pixel G and a red sub-pixel R from the left may be referred to as a (1-2)-th sub-pixel row SPR1-2. The second sub-pixel row SPR2 including the second sub-pixel groups SPG2 in which sub-pixels are disposed in the order of a first blue sub-pixel B1 and a second blue sub-pixel B2 from the left may be referred to as a (2-1)-th sub-pixel row SPR2-1, and the second sub-pixel row SPR2 including the second sub-pixel groups SPG2 in which sub-pixels are disposed in the order of a second blue sub-pixel B2 and a first blue sub-pixel B1 from the left may be referred to as a (2-2)-th sub-pixel row SPR2-2. In this case, the (1-1)-th sub-pixel row SPR1-1 and the (1-2)-th sub-pixel row SPR1-2 may be arranged alternately. In addition, the (2-1)-th sub-pixel row SPR2-1 and the (2-2)-th sub-pixel row SPR2-2 may be arranged alternately. For example, as illustrated in FIG. 6, in the case where a specific sub-pixel row is the (1-1)-th sub-pixel row SPR1-1, a sub-pixel row two rows below the specific sub-pixel row and a sub-pixel row two rows above the specific sub-pixel row may be the (1-2)-th sub-pixel row SPR1-2.

Through this arrangement method, one pixel P may include four sub-pixels, in other words, a red sub-pixel R, a green sub-pixel G, a first blue sub-pixel B1, and a second blue sub-pixel B2, and these pixels P may be arranged in the display unit 120.

Referring to FIG. 7, sub-pixels may be disposed in different ways in the display unit 120 of the display device 100 according to the present exemplary embodiment. In other words, only the red sub-pixel R or the green sub-pixel G may be disposed in a second direction to form a column. In this case, the first blue sub-pixel B1 and the second blue sub-pixel B2 may be disposed in a space (or column) between the red sub-pixel R and the green sub-pixel G. In other words, as illustrated in FIG. 7, respective sub-pixels may be arranged in zigzags in the display unit 120.

In other words, sub-pixels may be arranged in one of the ways illustrated in FIG. 6 and FIG. 7 in the display unit 120 of the display device 100. Furthermore, pixels P including the red sub-pixel R, the green sub-pixel G, the first blue sub-pixel B1, and the second blue sub-pixel B2 may be arranged in various ways in the display unit 120.

The display device 100 and the method of driving the same according to the exemplary embodiments of the inventive concept may provide a wake-up or sleeping-inducing effect to a user depending on a time and a place. In addition, the display device 100 and the method of driving the same according to the exemplary embodiments of the inventive concept may provide a wake-up or sleeping-inducing effect to a user by making the central wavelengths of light emitted from two blue sub-pixels different from each other in the case where each of the pixels included in the display device 100 includes one red sub-pixel, one green sub-pixel, and two blue sub-pixels.

The exemplary embodiments of the inventive concept may be embodied in the form of computer program(s) executable through various components on a computer, and the computer program(s) may be recorded on a non-transitory computer-readable recording medium. In this case, examples of the non-transitory computer-readable recording medium include magnetic recording media such as hard disks, floppy disks, and magnetic tapes, optical recording media such as compact disk read only memories (CD-ROMs) and digital video disks (DVDs), magneto-optical recording media such as floppy disks, and hardware devices such as ROMs, random access memories (RAMs), and flash memories that are configured to store and execute program commands. Furthermore, the non-transitory computer-readable recording medium may include an intangible medium embodied in a transmittable form on a network, and may be, for example, a medium embodied in the form of software or an application and transmittable and distributable via a network.

Examples of the computer programs include machine language codes that may be generated by a compiler, and high-level language codes that may be executed by a computer by using an interpreter.

The methods according to exemplary embodiments of inventive concept are not necessarily limited to the described order of the operations. For example, certain steps may be performed out of order.

While the inventive concept has been particularly shown and described with reference to exemplary embodiments thereof, it will be understood by those of ordinary skill in the art that various changes in form and details may be made therein without departing from the spirit and scope of the inventive concept as defined by the following claims.

What is claimed is:

1. A display device, comprising:

a display unit;

a plurality of pixels disposed in the display unit, each of the pixels comprising a red sub-pixel, a green sub-pixel, a first blue sub-pixel and a second blue sub-pixel;

a driving mode controller configured to set a driving mode to one of a first driving mode in which both of the first and second blue sub-pixels emit light, and a second driving mode in which one of the first and second blue sub-pixels emits light;

an output signal generator configured to receive two successive input image signals including first and second input image signals, and generate an output signal based on the two successive input image signals, wherein the first blue sub-pixel emits light of a first frequency, and the second blue sub-pixel emits light of a second frequency different from the first frequency, wherein the first input image signal includes a first red image signal, a first green image signal and a first blue image signal, and the second input image signal includes a second red image signal, a second green image signal and a second blue image signal, and wherein the output signal includes an output red image signal corresponding to the red sub-pixel, an output green image signal corresponding to the green sub-pixel, a first output blue image signal corresponding to the first blue sub-pixel, and a second output blue image signal corresponding to the second blue sub-pixel, wherein the second driving mode includes a (2-1)-th driving mode in which the first blue sub-pixel emits light, and when the driving mode is the (2-1)-th driving mode, the output signal generator generates the first output blue image signal based on the first and second blue image signals according to the following equation:

$$BO1 = 255 \times \left( \frac{\left(\frac{BI1}{255}\right)^{2.2} + \left(\frac{BI2}{255}\right)^{2.2}}{2} \right)^{\frac{1}{2.2}},$$

wherein BO1 is the first output blue image signal, BI1 is the first blue image signal and BI2 is the second blue image signal.

2. The device of claim 1, wherein a central wavelength of the light emitted from the first blue sub-pixel is longer than a central wavelength of the light emitted from the second blue sub-pixel.

3. The device of claim 1, wherein a central wavelength of the light emitted from the first blue sub-pixel is in a range from about 464 nm to about 470 nm, and a central wavelength of the light emitted from the second blue sub-pixel is in a range from about 440 nm to about 464 nm.

4. The device of claim 1, wherein the second driving mode includes a (2-2)-th driving mode in which the second blue sub-pixel emits light.

5. The device of claim 4, wherein the driving mode controller is configured to determine a current time as day or night, set the driving mode to one of the first driving mode and the (2-1)-th driving mode when the current time is day, and set the driving mode to the (2-2)-th driving mode when the current time is night.

6. The device of claim 4, wherein the driving mode controller is configured to determine a current location as an outdoor space or an indoor space, set the driving mode to the first driving mode when the current location is the outdoor space, and set the driving mode to one of the (2-1)-th driving mode and the (2-2)-th driving mode when the current location is the indoor space.

7. The device of claim 4, wherein the output signal generator:

generates the first and second output blue image signals to allow the first and second blue sub-pixels to emit light when the driving mode is the first driving mode, and generates the second output blue image signal based on the first and second blue image signals to allow the second blue sub-pixel to emit light when the driving mode is the (2-2)-th driving mode.

8. The device of claim 7, wherein the output signal generator:

generates the output red image signal based on the first and second red image signals, generates the output green image signal based on the first and second green image signals, when the driving mode is the first driving mode, generates the first output blue image signal same as the first blue image signal and the second output blue image signal same as the second blue image signal, and when the driving mode is the (2-2)-th driving mode, generates the second output blue image signal based on the first and second blue image signals according to the following equation:

$$BO1 = 255 \times \left( \frac{\left(\frac{BI1}{255}\right)^{2.2} + \left(\frac{BI2}{255}\right)^{2.2}}{2} \right)^{\frac{1}{2.2}},$$

wherein BO2 is the second output blue image signal.

9. The device of claim 8, further comprising:

a source driver configured to receive the output red image signal, the output green image signal, and the first and second output blue image signals, and apply data signals to the plurality of pixels, wherein the source driver:

applies a data signal generated based on the output red image signal to the red sub-pixel, applies a data signal generated based on the output green image signal to the green sub-pixel, applies a data signal generated based on the first output blue image signal to the first blue sub-pixel, and applies a data signal generated based on the second output blue image signal to the second blue sub-pixel.

10. The device of claim 7, wherein the output signal generator is configured to perform gamma correction by using a first gamma value when the driving mode is the first driving mode, by using a second gamma value when the driving mode is the (2-1)-th driving mode, and by using a third gamma value when the driving mode is the (2-2)-th driving mode.

11. The device of claim 1, wherein each of the plurality of pixels comprises a first sub-pixel group comprising the red sub-pixel and the green sub-pixel arranged in a first direction, and a second sub-pixel group comprising the first and second blue sub-pixels arranged in the first direction, and the display unit comprises a first sub-pixel row in which the first sub-pixel group is arranged in the first direction, and a second sub-pixel row in which the second sub-pixel group is arranged in the first direction.

12. The device of claim 11, wherein the display unit comprises the first and second sub-pixel rows arranged in a second direction substantially perpendicular to the first direction, the first sub-pixel row comprises:

a (1-1)-th sub-pixel row in which the red sub-pixel and the green sub-pixel are repeatedly arranged in sequence, and a (1-2)-th sub-pixel row in which the green sub-pixel and the red sub-pixel are repeatedly arranged in sequence, and the second sub-pixel row comprises:

a (2-1)-th sub-pixel row in which the first blue sub-pixel and the second blue sub-pixel are repeatedly arranged in sequence, and a (2-2)-th sub-pixel row in which the second blue sub-pixel and the first blue sub-pixel are repeatedly arranged in sequence.

13. A method of driving a display device comprising a display unit, a plurality of pixels disposed in the display unit, each pixel comprising a red sub-pixel, a green sub-pixel, a first blue sub-pixel and a second blue sub-pixels, a driving mode controller configured to set a driving mode to one of a first driving mode in which both of the first and second blue sub-pixels emit light, a (2-1)-th driving mode in which the first blue sub-pixel emits light, and a (2-2)-th driving mode in which the second blue sub-pixel emits light, wherein the first blue sub-pixel emits light of a first frequency, and the second blue sub-pixel emits light of a second frequency different from the first frequency, the method comprising:

receiving two successive input image signals including first and second input image signals, the first input image signal including a first red image signal, a first green image signal and a first blue image signal, and the second input image signal including a second red image signal, a second green image signal and a second blue image signal;

generating an output signal based on the two successive input image signals, the output signal including an output red image signal corresponding to the red sub-pixel, an output green image signal corresponding to the green sub-pixel, a first output blue image signal corresponding to the first blue sub-pixel, and a second output blue image signal corresponding to the second blue sub-pixel;

determining a current time as day or night;

determining a current position as an outdoor space or an indoor space; and setting the driving mode to the first driving mode when the current time is day and the current position is the outdoor space, setting the driving mode to the (2-1)-th driving mode when the current time is day and the current position is the indoor space, and setting the driving mode to the (2-2)-th driving mode when the current time is night, wherein the generating of the output signal comprises:

generating the first output blue image signal based on the first and second blue image signals to allow the first blue sub-pixel to emit light when the driving mode is the (2-1)-th driving mode, and generating the second output blue image signal based on the first and second blue image signals to allow the second blue sub-pixel to emit light when the driving mode is the (2-2)-th driving mode, when the driving mode is the (2-1)-th driving mode, the first output blue image signal based on the first and second blue image signals is generated according to the following equation:

$$BO1 = 255 \times \left( \frac{\left(\frac{BI1}{255}\right)^{2.2} + \left(\frac{BI2}{255}\right)^{2.2}}{2} \right)^{\frac{1}{2.2}},$$

and when the driving mode is the (2-2)-th driving mode, the second output blue image signal based on the first and second blue image signals is generated according to the following equation:

$$BO1 = 255 \times \left( \frac{\left(\frac{BI1}{255}\right)^{2.2} + \left(\frac{BI2}{255}\right)^{2.2}}{2} \right)^{\frac{1}{2.2}},$$

wherein BO1 is the first output blue image signal, BO2 is the second output blue image signal, BI1 is the first blue image signal and BI2 is the second blue image signal.

14. The method of claim 13, wherein the generating of the output signal comprises:

generating the first and second output blue image signals to allow the first and second blue sub-pixels to emit light when the driving mode is the first driving mode.

15. The method of claim 14, wherein the generating of the output signal comprises:

generating the output red image signal based on the first and second red image signals; and generating the output green image signal based on the first and second green image signals, when the driving mode is the first driving mode, generating the first output blue image signal same as the first blue image signal and the second output blue image signal same as the second blue image signal.

16. The method of claim 15, further comprising:

after the generating of the output signal, applying a data signal generated based on the output red image signal to the red sub-pixel, applying a data signal generated based on the output green image signal to the green sub-pixel, applying a data signal generated based on the first output blue image signal to the first blue sub-pixel, and applying a data signal generated based on the second output blue image signal to the second blue sub-pixel.

17. The method of claim 14, wherein the generating of the output signal comprises:

performing gamma correction by using a first gamma value when the driving mode is the first driving mode, by using a second gamma value when the driving mode is the (2-1)-th driving mode, and by using a third gamma value when the driving mode is the (2-2)-th driving mode.

18. A display device, comprising:

a display unit;

a plurality of pixels disposed in the display unit, each of the pixels comprising a red sub-pixel, a green sub-pixel, a first blue sub-pixel and a second blue sub-pixel;

a driving mode controller configured to set a driving mode to one of a first driving mode in which both of the first and second blue sub-pixels emit light, and a second driving mode in which one of the first and second blue sub-pixels emits light;

an output signal generator configured to receive two successive input image signals including first and second input image signals, and generate an output signal based on the two successive input image signals, wherein the first blue sub-pixel emits light of a first frequency, and the second blue sub-pixel emits light of a second frequency different from the first frequency, wherein the first input image signal includes a first red image signal, a first green image signal and a first blue image signal, and the second input image signal includes a second red image signal, a second green image signal and a second blue image signal, and wherein the output signal includes an output red image signal corresponding to the red sub-pixel, an output green image signal corresponding to the green sub-pixel, a first output blue image signal corresponding to the first blue sub-pixel, and a second output blue image signal corresponding to the second blue sub-pixel, wherein the second driving mode includes a (2-1)-th driving mode in which the first blue sub-pixel emits light and a (2-2)-th driving mode in which the second blue sub-pixel emits light, and when the driving mode is the (2-2)-th driving mode, the output signal generator generates the second output blue image signal based on the first and second blue image signals according to the following equation:

$$BO1 = 255 \times \left( \frac{\left(\frac{BI1}{255}\right)^{2.2} + \left(\frac{BI2}{255}\right)^{2.2}}{2} \right)^{\frac{1}{2.2}},$$

wherein BO2 is the second output blue image signal, BI1 is the first blue image signal and BI2 is the second blue image signal.

* * * * *